United States Patent [19]

Colombo

[11] Patent Number: 4,633,933

[45] Date of Patent: Jan. 6, 1987

[54] CONTINUOUS CASTING PLANT

[75] Inventor: Piero Colombo, Udine, Italy

[73] Assignee: Continua International Continuous Casting, Italy

[21] Appl. No.: 702,022

[22] Filed: Feb. 15, 1985

[30] Foreign Application Priority Data

Feb. 17, 1984 [IT] Italy ..... 12436 A/84

[51] Int. Cl.[4] ..... B22D 11/126; B22D 11/16

[52] U.S. Cl. ..... 164/154; 164/263; 164/452; 164/460

[58] Field of Search ..... 164/263, 460, 451, 452, 164/154, 483, 5

[56] References Cited

U.S. PATENT DOCUMENTS 3,612,148 10/1971 Waldschmidt ..... 164/263 X
3,752,220 8/1973 Hofmann et al. ..... 164/263 X

FOREIGN PATENT DOCUMENTS 0007969 2/1980 European Pat. Off. ..... 164/263
2440414 11/1975 Fed. Rep. of Germany ..... 164/263
46-21824 6/1971 Japan ..... 164/154
595062 3/1978 U.S.S.R. ..... 164/263

*Primary Examiner*—Nicholas P. Godici
*Assistant Examiner*—J. Reed Batten, Jr.
*Attorney, Agent, or Firm*—King and Schickli

[57] ABSTRACT

A continuous casting plant comprising at least one casting line presenting a curved guide path for bending the casting leaving the casting mold from a substantially vertical direction to a rectilinear, substantially horizontal direction through a straightening machine and across a following cutting device for shearing the casting in a number of consecutive sections of predetermined length. Between the straightening machine and the cutting device a stepwise feeding device is provided for feeding the tail-end section of the casting across the cutting device and for operating the cutting device after each step so as to shear the tail-end section of the casting into comparatively small stubs which are discarded beneath the path of the casting by a chute.

6 Claims, 5 Drawing Figures

CONTINUOUS CASTING PLANT

BACKGROUND AND SUMMARY OF THE INVENTION

The present invention relates to continuous casting, and more particularly relates to a continuous casting plant for metals, and more particularly for steel, comprising at least one casting line presenting a curved guide path for bending the casting leaving the casting mold from a substantially vertical direction to a rectilinear, substantially horizontal direction through a straightening machine and across a following cutting device which shears the casting in a number of sections of predetermined length.

In the known continuous casting plants of the above described kind, at the end of each casting operation and for each casting line, on that portion of the path of the strand comprised between the straightening machine and the cutting device the last section of the casting, the so called tail-end section, is left.

The said tail-end section has a variable length, which is less than the length of the preceding sections but which may not withstanding be substantial, which must be discharged manually or by means of a crane from the path of the strand, in order to clear the casting line. The said tail-end section must be discarded since it is not usable for the following processing steps. In multi-line casting plants the said tail-end sections are formed at each line and represent a valuable loss of production.

It is therefore the main object of this invention to provide an improved arrangement for a continuous casting plant for the casting of curved strands in which the disadvantages of the prior art plants are overcome.

In accordance with this main object, between the straightening device and the following cutting device of at least one casting line of the casting plant, means are provided for stepwise feeding the tail-end section of the casting through the cutting device, and for operating said cutting device after each feed step of the said tail-end piece so as to cut the said tail-end piece into comparatively small stubs which are discharged downstream of the cutting device out of the path of the casting, and which are preferably discharged beneath this path by means of a chute.

The means for stepwise feeding the tail-end section across the cutting device, in order to reduce same into small stubs, may be of any suitable kind, and for instance may be formed by at least one pair of pinch-rolls, and/or by a longitudinal pushing device, formed for instance by a hydraulic or pneumatic pushing cylinder which is arranged so as to be shiftable into a rest position out of the path of the strand during the casting operation, and to be positioned into an operating position at the end of the casting operation, in which it is disposed in the path of the strand between the straightening device and the cutting device, rearwardly of the tail end section of the casting, so as to push also the last portion of said tail end section across the cutting device.

In the instance of continuous casting plants provided with two or more casting lines, measuring and programming means are provided according to the invention for programming the length or the single sections in which the casting must be cut on the single casting lines, which means automatically controls the casting operation on the several lines in such a manner that the tail-end section to be discarded is formed only on one single casting line, which is provided between the straightening device and the cutting device with the above-mentioned means for stepwise feeding the said tail end section across the cutting device, and for operating the said cutting device at each feed step of the said tail end section, so as to cut same into comparatively small stubs, whilst the end sections obtained from the castings on the remaining casting lines are exactly of the prefixed length. By operating in this manner, the following advantages are obtained with respect to the prior art casting plants:

The production of tail-end sections at the end of each casting operation is automatically limited to one single casting line. The tail-end section formed on the said casting line is cut in small stubs and discarded automatically, without hands. The reset time of the multiline casting plant is remarkably reduced, and the need of additional devices and/or hands for the following cool reduction into scrap of the tail-end sections to be discarded is obviated.

BRIEF DESCRIPTION OF THE DRAWINGS

The above and other characteristic features of the invention, as well as the advantages deriving therefrom, will appear evident from the following detailed description of a preferred embodiment of same, shown by way of non limiting example in the annexed drawings, in which.

DESCRIPTION OF THE PREFERRED EMBODIMENT OF THE INVENTION

Figure 1:
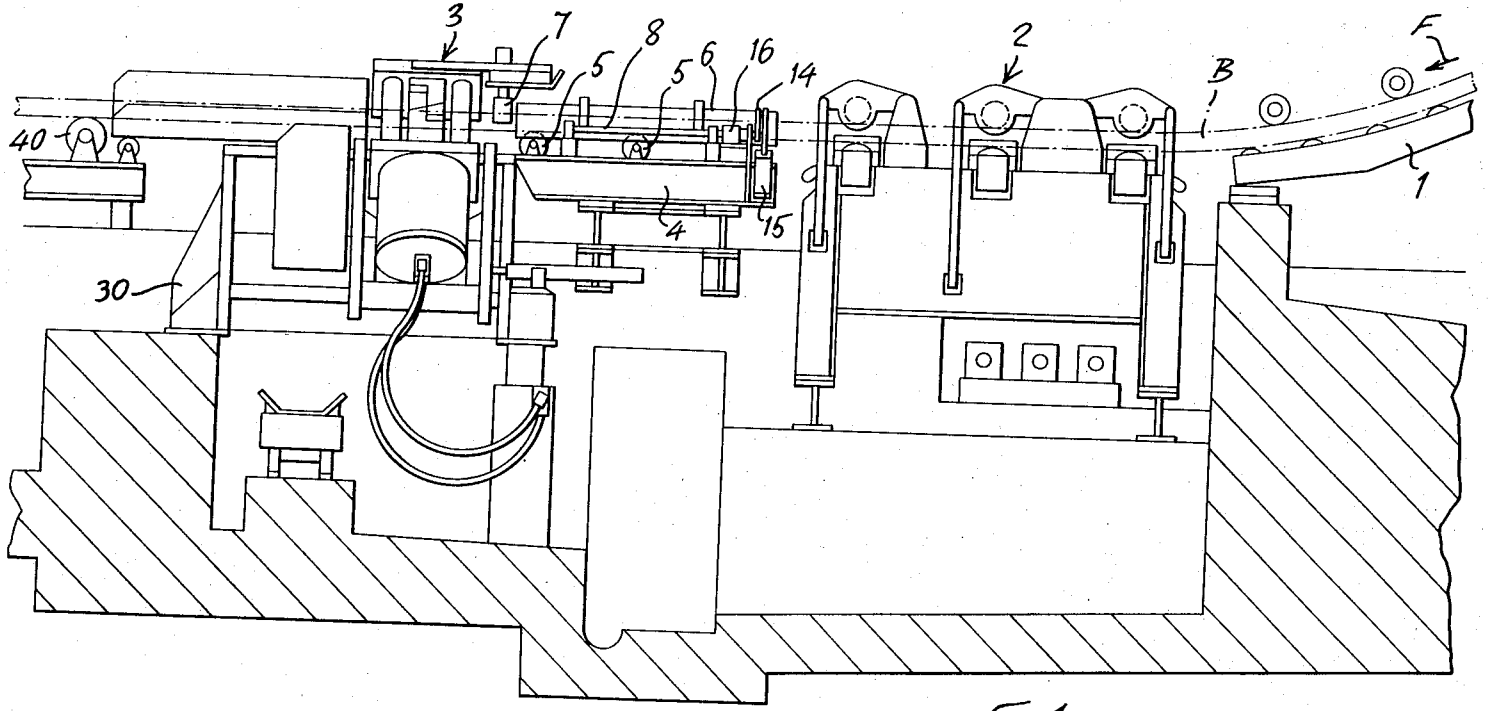
FIG. 1 is an elevational view of one portion of a continuous casting plant for casting curved castings according to the invention.

In the figures, numeral 1 denotes the end portion of the curved guide for the casting in a continuous casting plant for casting curved steel castings. In this plant, the casting B, shown by dash and dotted lines in FIG. 1, which is cast in a substantially vertical direction by means of an open, arcuated or straight mold (not shown), follows a curved path according to arrow F and leaves its curved guide 1 in a substantially horizontal direction. The casting B moves thereafter through a straightening device 2 and across a cutting device 3, from which it is cut into consecutive sections of predetermined length which are conveyed along the roller way 40. In the embodiment shown, the cutting device 3 is formed by a diagonal shear. Both the straightening device 2 and the shear 3 are per se know, and will therefore not be described with further details.

Figure 5:
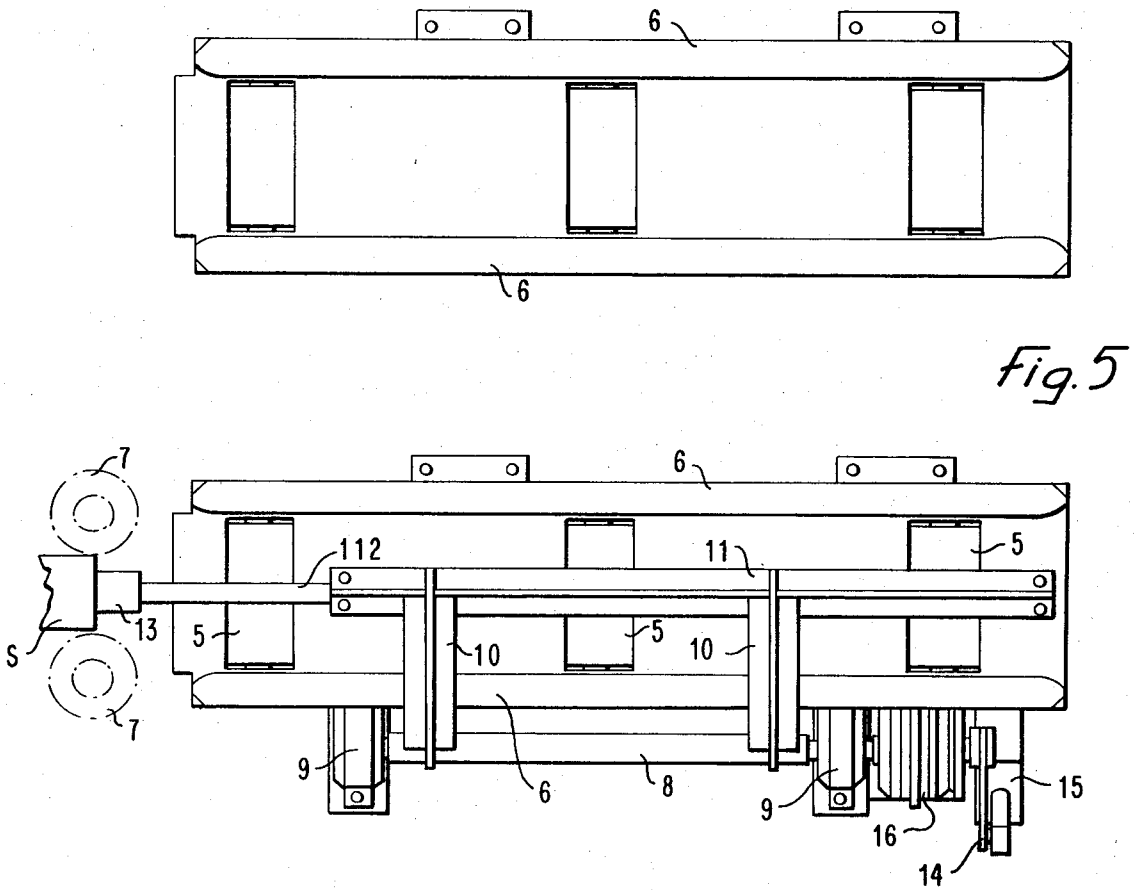
FIG. 5 is a top plan view similar to FIG. 2 but showing two casting lines side-by-side.

The continuous casting plant is provided with a plurality of casting lines (note FIG. 5). In one of the said casting lines, in the portion of the path of the strand B comprised between the straightening device 2 and the shear 3, a device is provided for stepwise feeding across the shear 3 the tail-end section S of the casting, namely the section of the casting which at the end of each casting operation is left between the straightening device 2 and the shear 3. The said stepwise feeding device comprises a bed 4 provided with an idle roller way 5 disposed at the bottom of the casting guide channel formed by two longitudinal side walls 6. At the end of the channel 6—6, between said channel and the shear 3 a pair of vertical axis pinch rollers 7 is mounted. A longitudinal beam 11, carrying a hydraulic or pneumatic pushing-expelling cylinder 12, the stem of which is provided with a pushing head 13, is secured by means of support arms 10 to a shaft 8, extending in the longitudinal direction of the roller way 5, and supported in bearings 9 disposed outside of the channel 6—6.

Figure 2:
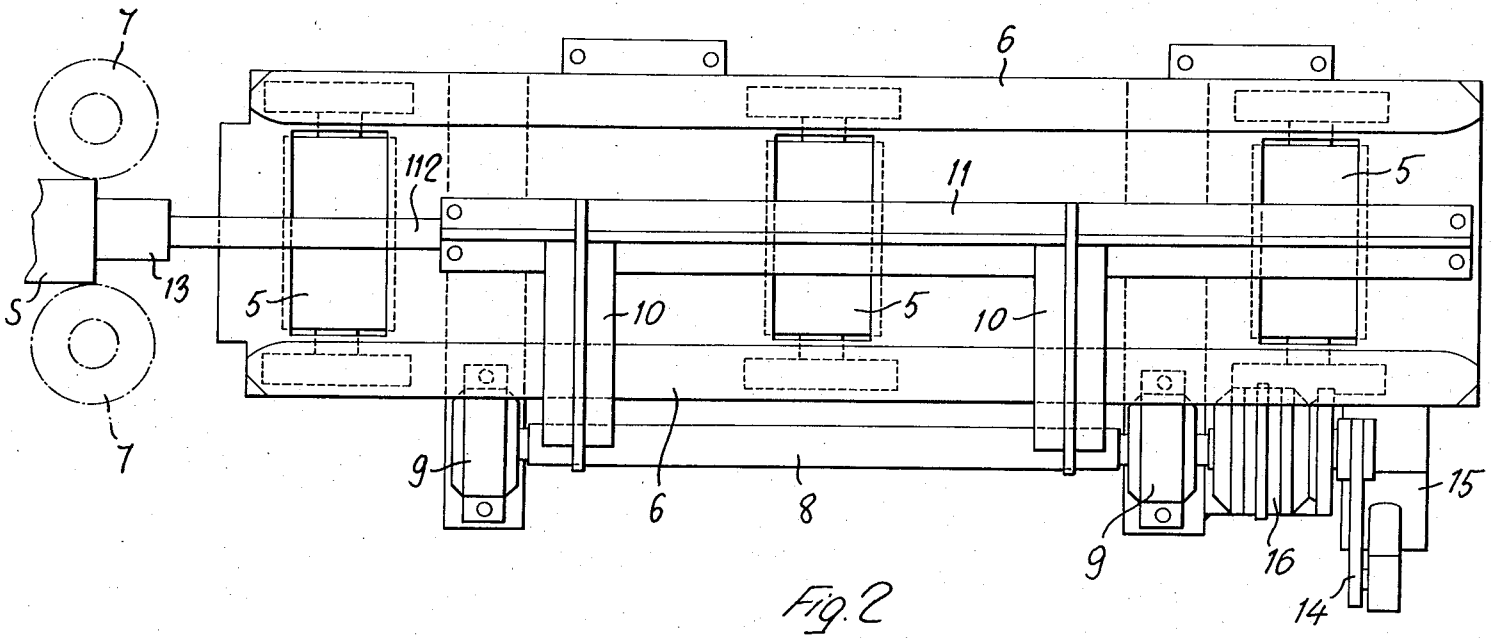
FIG. 2 is a top plan view of a device according to the invention for the stepwise feeding of the tail end section of the casting across the cutting device.
Figure 3:
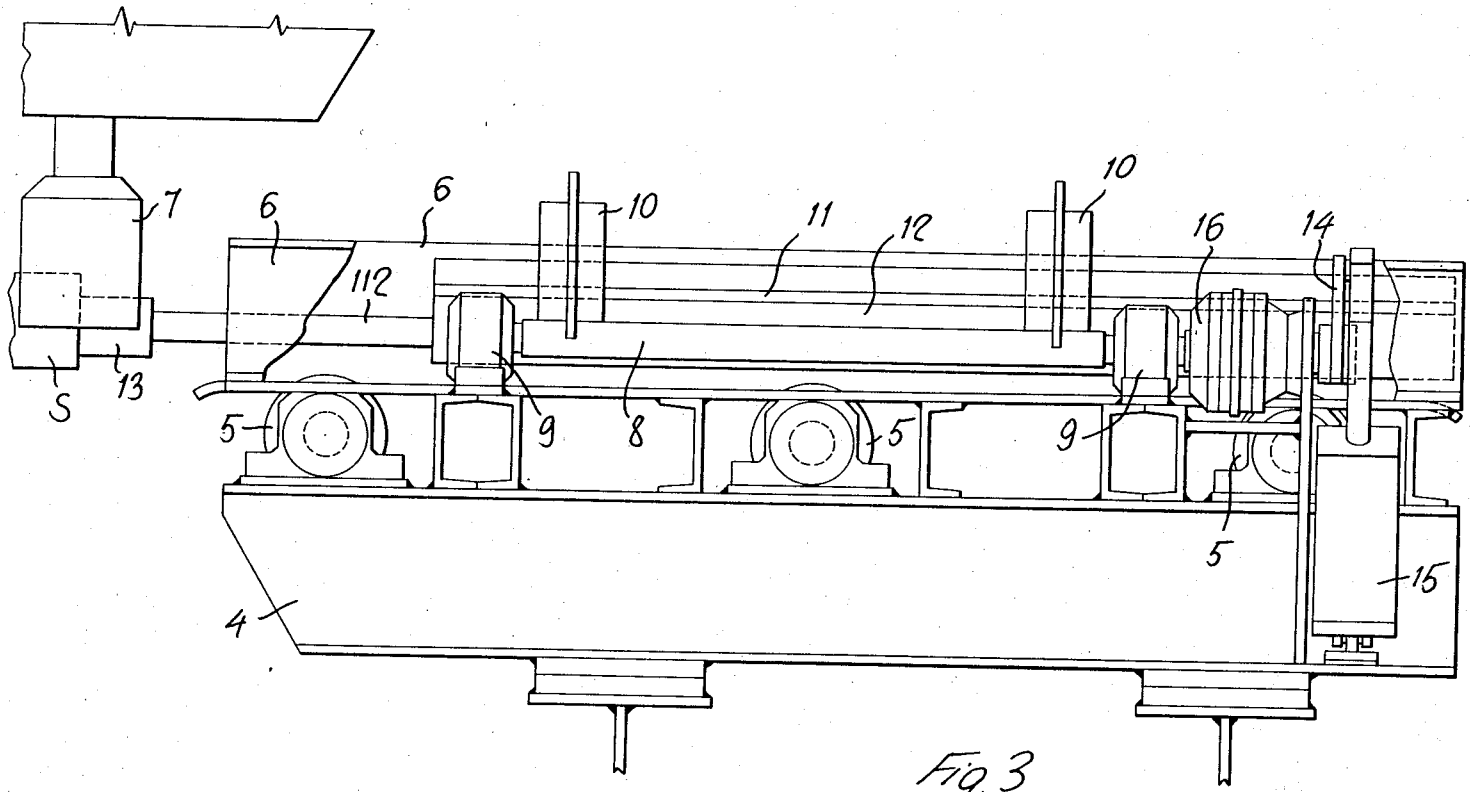
FIG. 3 is a side elevational view of the device of FIG. 2.
Figure 4:
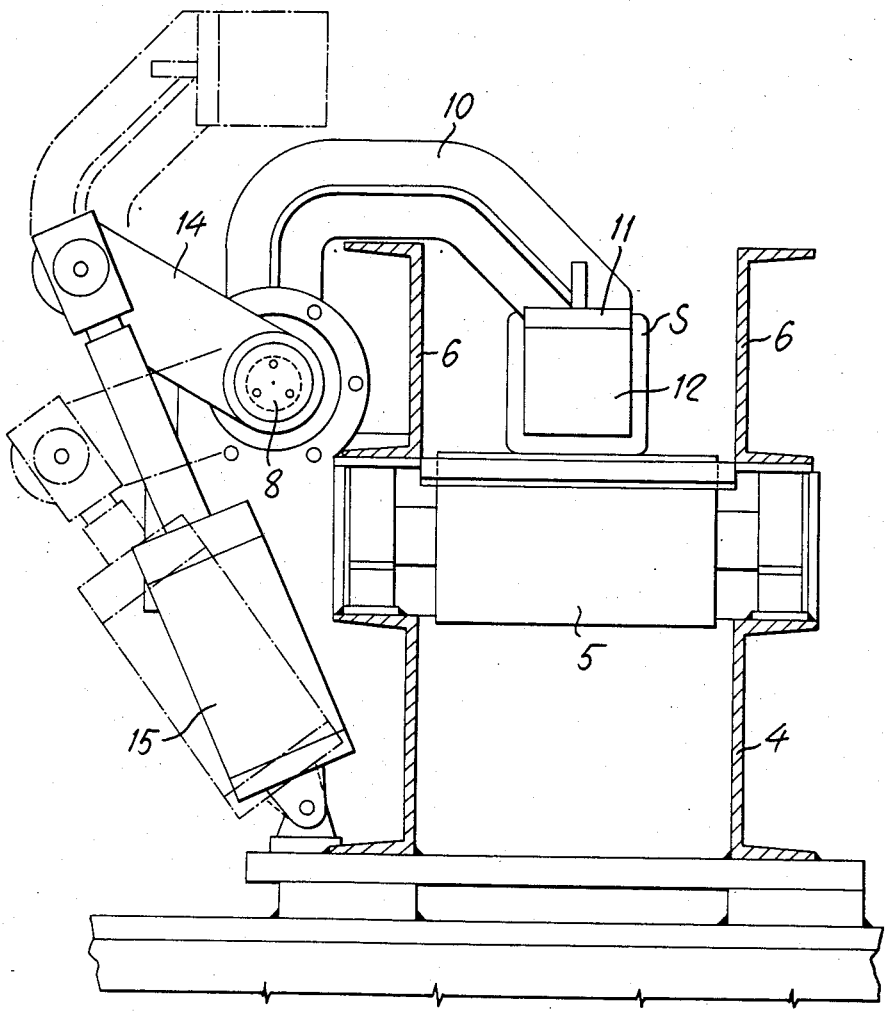
FIG. 4 is a vertical cross sectional view of the device of FIG. 2.

One end of the shaft 8 is connected to a lever arm 14 which may be angularly shifted by means of a hydraulic or pneumatic operated cylinder 15. By angularly shifting the said lever arm 14 by means of the cylinder 15, the shaft 8 may be rotated so as to move the pushing-expelling cylinder 12, through the support arms 10 and the beam 11, either in one inoperative rest position (shown with dotted and dashed line in FIG. 4), in which the said cylinder 12 is moved out of the casting guide channel 6—6, and for example in a lifted position sidewise of the said channel 6—6, in which it clears the passage for the casting B, or in an active expelling position (shown with solid lines in FIGS. 2 to 4), in which the expelling-pushing cylinder 12 is moved inside of the casting guide channel 6—6 in the path of the casting B. In order to obtain a sufficently wide angular movement of the shaft 8 with the support arms 10 and the cylinder 12 by a limited stroke of the operating cylinder 15 and of the lever arm 14, between the said lever arm 14 and the shaft 8 a reducer 16 may be interposed.

The continuous casting plant is provided with devices for measuring and programming the length of the section into which the castings B must be cut on the single casting lines. The said devices, which per se are known, are not shown. They are used, according to the invention, in order to interrupt the casting operation automatically on the single casting lines in such a manner that the last casting section obtained has the exact prefixed length on all casting lines, except the line provided between the straightening device 2 and the shear 3 with the pair of pinch rollers 7 and the pusher-expeller cylinder 12. As a consequence, only on this single casting line a tail-end section S is formed having a length less than the length prefixed for the single casting sections. The said tail-end section S is automatically stepwise fed by means of the pair of pinch rollers 7 through the shear 3 which is automatically operated after each feed step of the section S, so as to cut it into stubs of small dimensions, or anyway into slab stubs. The said stubs are discharged out of the path of the casting by means of a chute 30 in an underlying collecting bin.

The last portion of the section S, which cannot be pinched by the rollers 7, is fed across the shear 3 by means of the expeller-pusher cylinder 12 which at this end is moved from its rest position (shown with dotted and dashed lines in FIG. 4) to its operating expelling position (shown with solid lines in FIGS. 2 to 4), which pushes automatically, with the head 13 of the stem 112 passing between the pinch rollers 7, the last portion of the section S across the shear 3.

It is believed that the invention will have been clearly understood from the foregoing detailed description of the preferred embodiment. Changes in details of construction may be resorted to without departing from the spirit of the invention, and it is accordingly intended that no limitation be implied and that the hereto annexed claims be given the broadest interpretation to which the employed language fairly admits.

I claim:

1. A continuous casting plant including a casting path comprising:

a casting mold;

a casting line providing a curved guide path for bending a casting emerging from said casting mold from a substantially vertical direction to a substantially rectilinear direction different from the vertical;

a straightening machine;

a cutting device for shearing the casting into consecutive sections of predetermined length; and means for stepwise feeding a tail end section of the casting across the cutting device including a least one longitudinal pushing-expelling device having a fluid-operated pushing-expelling cylinder and means for alternately moving said cylinder between a rest position in which said cylinder is disposed clear of the casting path and an operative position in which said cylinder is disposed in the casting path between the straightening machine and the cutting device rearwardly of the tail end section of the casting.

2. A continuous casting plant according to claim 1, comprising two or more casting lines, characterized by the fact that the said means for stepwise feeding the tail end section of the casting across the cutting device and for operating said cutting device after each of the said feed steps are provided only in correspondence of one casting line, programming means being provided for automatically controlling the operation of the plant in such a manner that the said tail end section is formed only in correspondence of the one casting line provided with the said stepwise feeding means, whilst the casting operation on any remaining casting lines is interrupted automatically whenever a last section of the casting being cast has reached a prefixed length.

3. A continuous casting plant according to claim 1, characterized by the fact that the said means for stepwise feeding the tail-end section of the casting across the cutting device includes at least one pair of pinch rollers.

4. A continuous casting plant according to claim 1, in which the said means for alternately moving the said cylinder in and out of the path of the casting comprises at least one support arm fulcrumed to a longitudinal axis disposed outside of the casting path, sidewise of said path, means being provided for lifting and lowering said support arm.

5. A continuous casting plant according to claim 1, further comprising downstream of the cutting device means for discharging the said tail end cutting stubs out of the path of the casting.

6. A continuous casting plant according to claim 5, in which said means are in the form of a chute, which discharges the said stubs beneath the path of the casting.

* * * * *